US007527131B1

(12) United States Patent
Wike

(10) Patent No.: US 7,527,131 B1
(45) Date of Patent: May 5, 2009

(54) RAILWAY FREIGHT CAR TRUCK

(75) Inventor: Paul Steven Wike, St. Louis, MO (US)

(73) Assignee: AMSTED Rail Company, Inc., Granite City, IL (US)

( * ) Notice: Subject to any disclaimer, the term of this patent is extended or adjusted under 35 U.S.C. 154(b) by 0 days.

(21) Appl. No.: 12/287,020

(22) Filed: Oct. 6, 2008

(51) Int. Cl.
*B61H 13/36* (2006.01)
*B61F 3/00* (2006.01)

(52) U.S. Cl. ..... 188/219.6; 188/219.1; 188/223.1; 188/226.1; 105/182.1; 105/197.05

(58) Field of Classification Search ..... 105/182.1, 105/197.05; 188/219.1, 219.6, 223.1, 226.1, 188/228.1, 229.6, 232, 207, 52
See application file for complete search history.

(56) References Cited

U.S. PATENT DOCUMENTS 727,218 A * 5/1903 Shepard ..... 188/219.6
1,694,989 A * 12/1928 Sleeman ..... 188/219.6
2,873,824 A * 2/1959 Opsahl ..... 188/226.1
2,946,410 A * 7/1960 Spaeth ..... 188/219.6
2,973,063 A * 2/1961 Spaeth ..... 188/229.6
3,169,609 A * 2/1965 Opsahl ..... 188/219.6
3,865,045 A * 2/1975 Jones, Jr. ..... 105/199.1
4,458,604 A * 7/1984 Cope ..... 105/168
4,480,721 A * 11/1984 Murphy ..... 188/52
4,775,035 A * 10/1988 Brodeur et al. ..... 188/195
5,000,298 A * 3/1991 Jackson et al. ..... 188/219.1
5,456,337 A * 10/1995 Jackson ..... 188/52
5,785,159 A * 7/1998 Jackson et al. ..... 188/219.1
5,947,236 A * 9/1999 Sauter ..... 188/228.1
6,125,767 A * 10/2000 Hawthorne et al. ..... 105/206.1
6,155,387 A * 12/2000 Sauter ..... 188/226.1
6,155,389 A * 12/2000 Sandmann ..... 188/226.1
6,176,354 B1 * 1/2001 Sauter et al. ..... 188/219.6
6,193,028 B1 * 2/2001 Elizalde-Siller et al. ..... 188/232
6,234,283 B1 * 5/2001 Montes-Ramos ..... 188/219.1
6,279,696 B1 * 8/2001 Daugherty et al. ..... 188/215
7,430,794 B2 * 10/2008 Steffen et al. ..... 29/402.01
2006/0219502 A1 * 10/2006 De La Fuente-Farias . 188/219.6

* cited by examiner

*Primary Examiner*—S. Joseph Morano
*Assistant Examiner*—Jason C Smith
(74) *Attorney, Agent, or Firm*—Edward J. Brosius

(57) ABSTRACT

An improved railway car truck is provide that includes two sideframes and a bolster. The bolster has laterally opposite ends, each end extending into and supported within a sideframe opening on a spring group. Each sideframe also has a pedestal opening at each end to receive a bearing adapter assembly. The railway car truck also includes two brake beam assemblies supported on the railway car truck bolster and sideframes. Each brake beam assembly includes an elongated main section, a support section, and a standoff section extending between the main section and support section. Two brake hangers comprised of a leg sections and a bottom section support an end of the brake beam assembly. The brake hangers can be reversed such that the brake head support sections can be spaced laterally to adapt to different rail gauges. Further, an improved center plate is provided on an upper surface of the bolster, wherein the center plate includes a center plate liner which is comprised of a circular disk of austempered ductile iron.

14 Claims, 8 Drawing Sheets

RAILWAY FREIGHT CAR TRUCK

BACKGROUND OF THE INVENTION

The present invention relates to a railway freight car truck and, more particularly, to an improved railway freight car truck having a brake beam adaptable for differing rail gauges.

In a railway freight car truck, two axles are held in a pair of laterally spaced sideframes, with a bolster extending laterally between and supported on each sideframe. The wheels are press fit on the axles, with the ends of the axles also fitted with a roller bearing assembly. The roller bearing assembly itself is fit into a bearing adapter that is fit into a pedestal jaw opening at the longitudinal end of each sideframe. The ends of the bolsters are themselves supported on spring groups, which are supported on the lower portion of the center openings of the sideframes.

A bearing adapter and pad assembly can also be provided that is useful in the fitting of the roller bearing assembly into the pedestal jaw opening of each sideframe. The bearing adapter, which is itself fit on top of the bearing assembly, is comprised of a unitary cast steel piece. An elastomeric adapter pad is fitted on top of the bearing adapter.

Two side bearings are also typically provided in an upper surface of the bolster to assist in supporting a car bolster that is part of the structure of the freight car.

Each railway freight car truck also includes two brake beams that act to transmit braking force through brake shoes to the outer tread of the railway wheels.

It is an object of the present invention to provide an improved railway truck having a brake beam support that can adapt to different rail gauges.

SUMMARY OF THE INVENTION

A railway freight car truck of the so-called three piece standard design, is comprised of two laterally spaced, unitary cast steel sideframes and a laterally extending bolster, also of a unitary cast steel structure. The ends of the bolster are received and supported on spring groups that themselves are supported on the bottom section of a bolster opening in each sideframe.

The wheel axle assemblies themselves are received in openings, commonly referred to as pedestal jaw openings, at longitudinal ends of each sideframe. The wheel axle assemblies themselves extend laterally between the sideframes, and hence, also laterally between the two spaced railway tracks. For improved performance of the railway freight car truck, it is desirable to receive the bearings press fit on each axle end into a bearing adapter assembly. Each railway car truck includes two brake beam assemblies. Each brake beam assembly is comprised of a main section and a support section. Two brake hangers support the main section of the brake beam assembly. The brake hangers can be reversed in order to allow the brake beam assembly to adapt to different rail gauges.

DETAILED DESCRIPTION OF THE INVENTION

Figure 1:
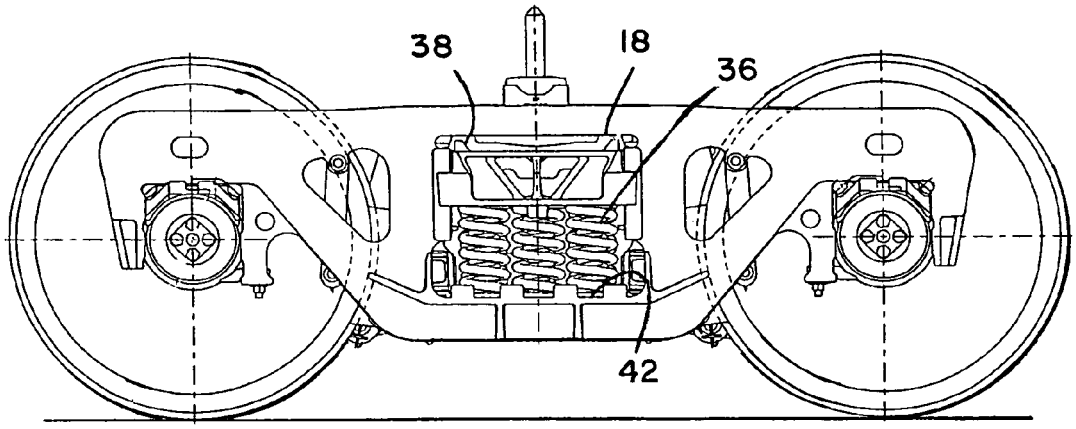
FIG. 1 is a side view of a first embodiment of a railway car truck in accordance with the present invention.
Figure 2:
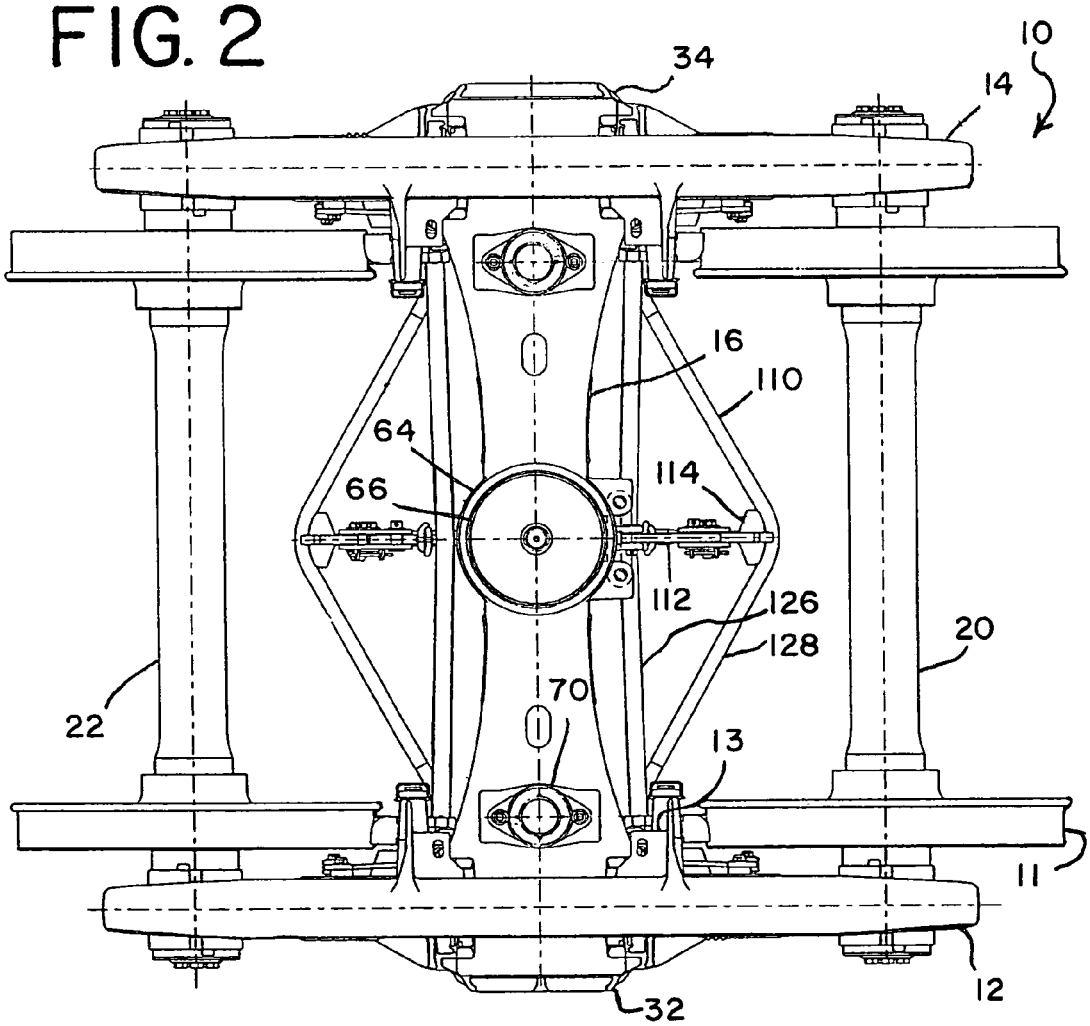
FIG. 2 is a top view of the first embodiment of a railway car truck in accordance with the present invention.
Figure 2A:
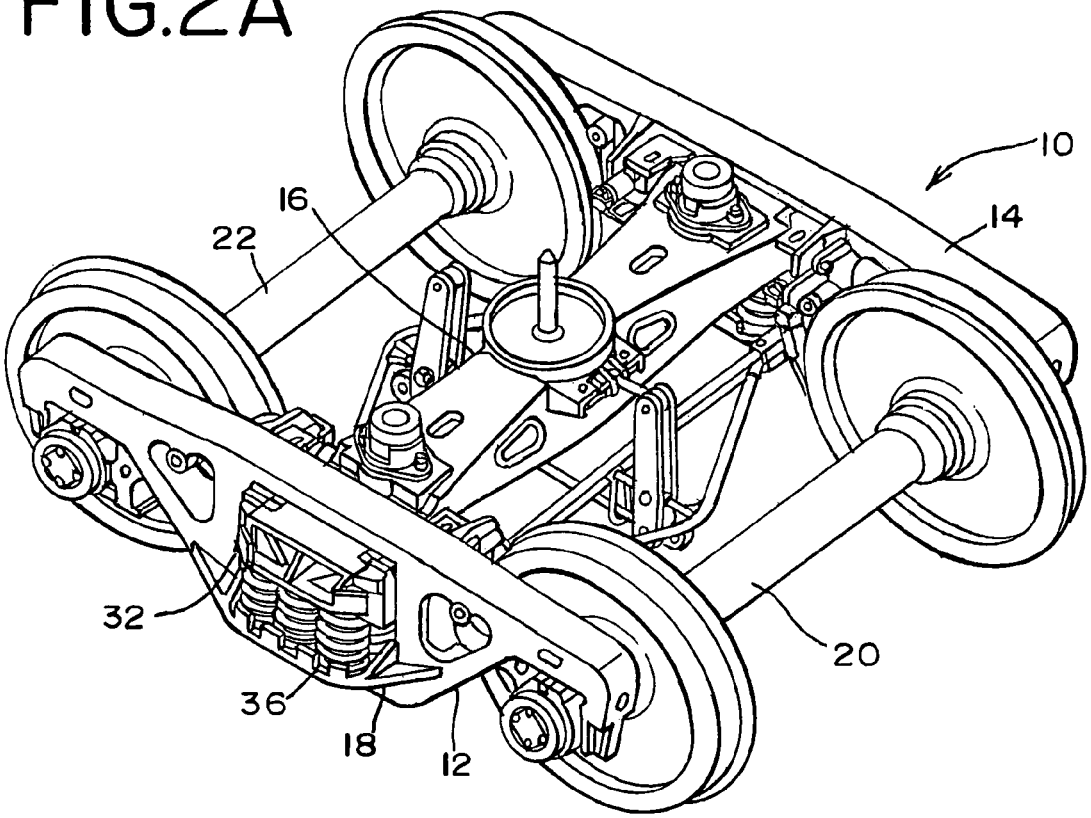
FIG. 2A is a perspective view of a first embodiment of railway car truck in accordance with the present invention.
Figure 3:
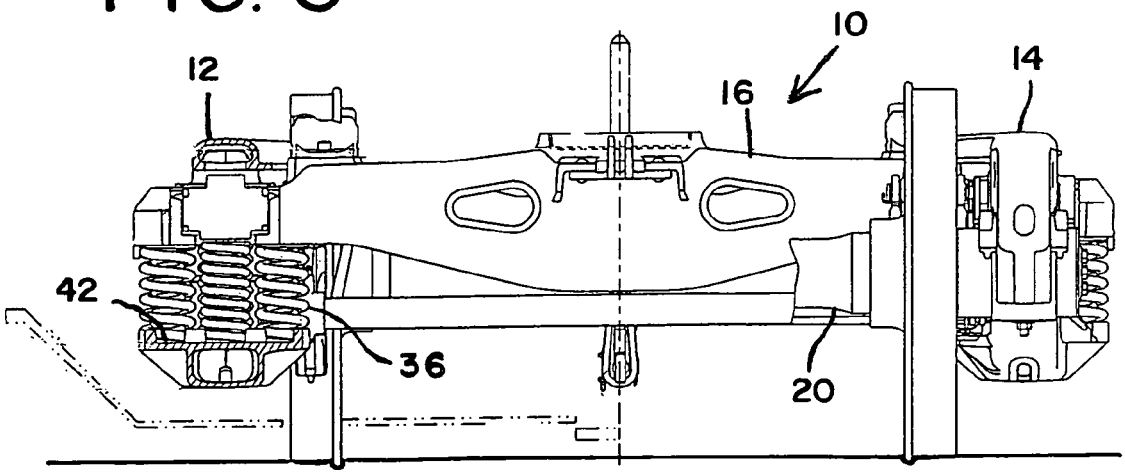
FIG. 3 is an end view, in partial cross section, of the first embodiment of a railway car truck in accordance with the present invention.
Figure 17:
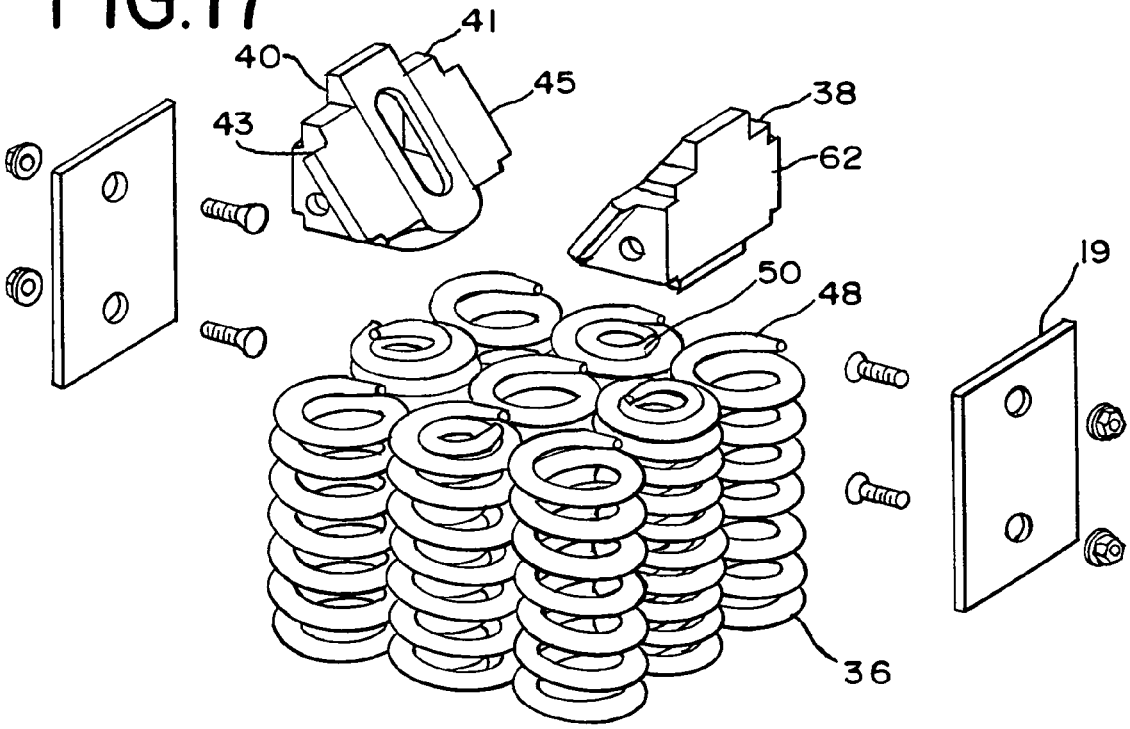
FIG. 17 is an exploded view of a first embodiment of a spring group with friction shoes and wear plates in accordance with the present invention.

Referring now to FIGS. 1-3, a railway truck is show generally at 10. Railway truck 10 is seen to comprise two laterally spaced sideframes 12 and 14, between which bolster 16 extends. Bolster 16 is seen to include bolster ends 32 and 34, which extend through sideframe openings 18. Spring group 36, shown in detail in FIG. 17, is seen to support bolster end 32 on sideframe lower support 42.

Each of sideframes 12 and 14 and bolster 16 are usually a cast steel unitary structure. Various internal ribs and supports lend strength, along with a savings in overall weight for each of such cast steel truck components.

Bolster 16 is also seen to include on its upper surface a bolster center plate 64, which itself includes a bolster center plate wear liner 66. Also included on the upper surface of bolster 16 are a pair of laterally spaced sidebearings 70.

Axles 20 and 22 extend laterally between sideframes 12 and 14. Railway wheels 11 are press fit on the ends of axles 20 and 22.

Figure 4:
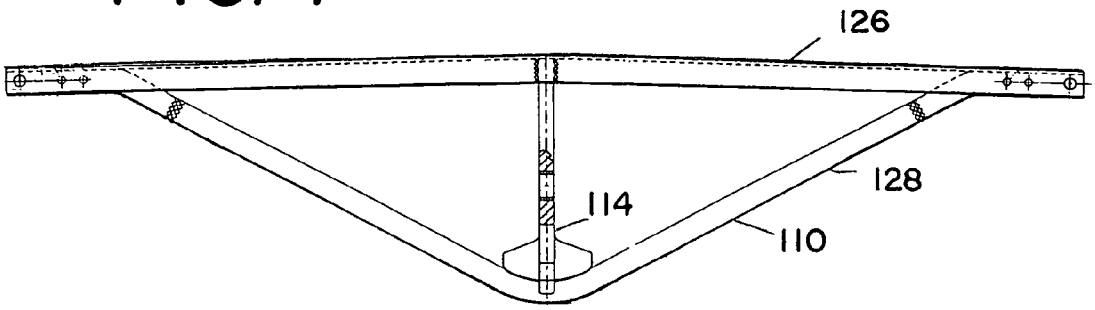
FIG. 4 is a top view of a first embodiment of a brake beam assembly in accordance with the present invention.
Figure 5:
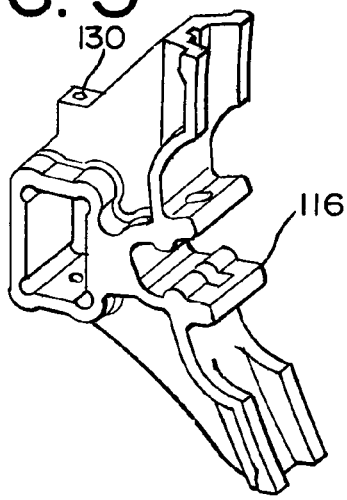
FIG. 5 is a perspective view of a first embodiment of a brake head in accordance with the present invention.

Referring now to FIG. 4 brake beam assembly 110 is supported from sideframes 12 and 14 and bolster 16. Brake beam 110 is seen to be comprised of main section 126 which is generally elongated and extends laterally between sideframes 12 and 14. Brake beam section support section 128 is seen to extend at an acute angle from ends of brake beam main section 126. Standoff section 112 extends from a center portion of brake beam main section 126 to the apex of curved or bent brake beam support section 128.

Brake beam assembly 110 is typically comprised of structural steel main section 126 typically in the form of a hollow structural steel section, as is brake beam support section 128. Standoff section 114 is typically a fabricated structural steel component.

Figure 7:
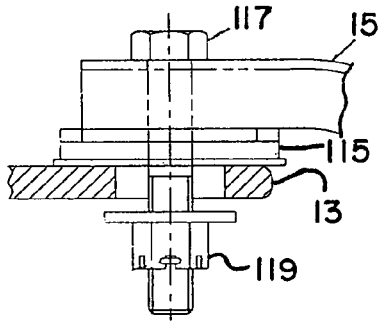
FIG. 7 is a detailed view of the first embodiment of a railway car truck in accordance with the present invention showing the load beam connection to the sideframe.
Figure 6:
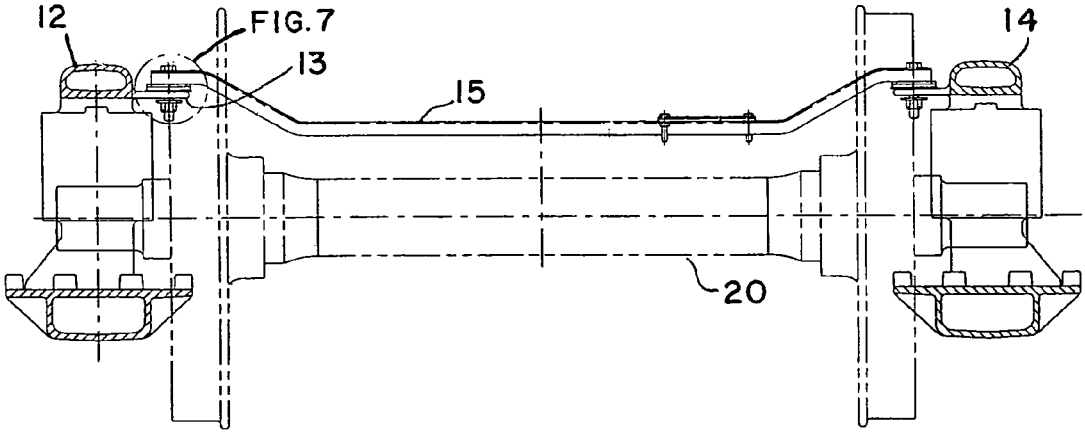
FIG. 6 is a partial in partial cross section of the first embodiment of a railway car truck in accordance with the present invention showing a load beam.

Referring now to FIGS. 6 and 7, a partial cross sectional view of railway truck 10 is shown. Sideframes 12 and 14 are shown in general cross section, with a sideframe load beam support 13 extending from a top section of sideframe 12 with a similar sideframe load beam support extending from the top section of sideframe 14. A structural steel load beam 15 extends laterally between the sideframe side load beam support. Load beam 15 is seen to comprise an end section having an opening adapted to receive load beam bolt 117. Load beam bolt 117 extends through a complementary opening in sideframe load beam support 13. An appropriate locking nut or similar fastening device 119 is seen to be affixed to load beam bolt 117.

Figure 8:
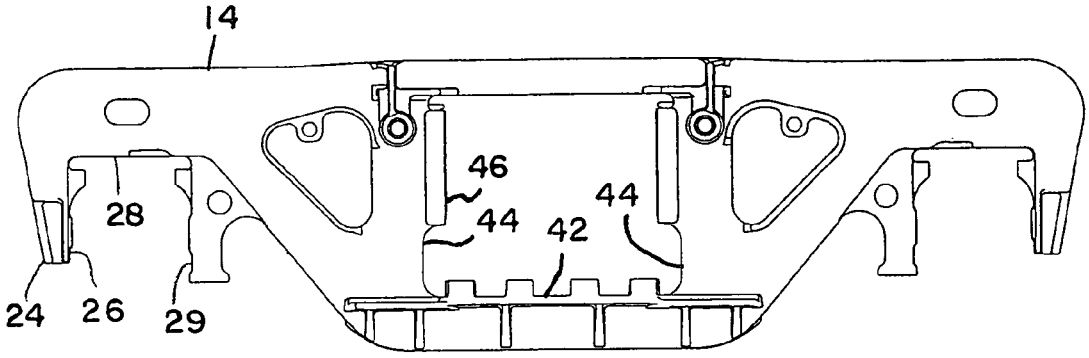
FIG. 8 is a side view of a first embodiment of a sideframe in accordance with the present invention.
Figure 9:
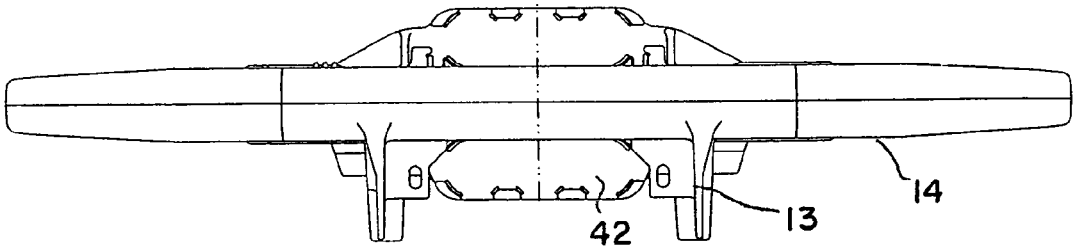
FIG. 9 is a top view of the first embodiment of a sideframe in accordance with the present invention.
Figure 10:
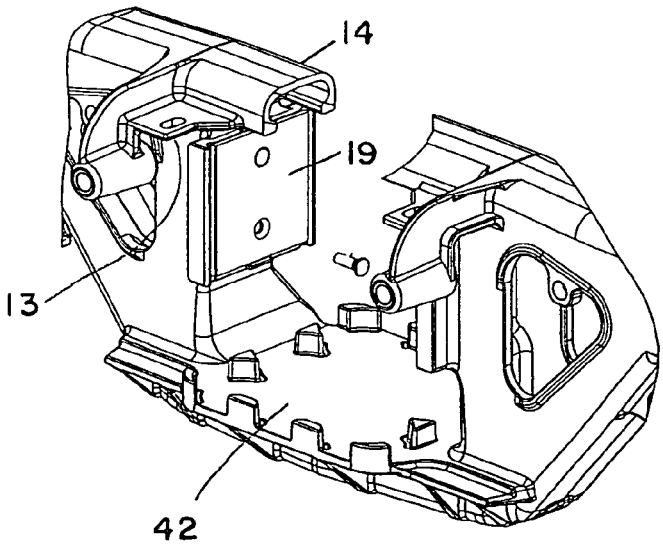
FIG. 10 is a partial detailed view of the first embodiment of a sideframe in accordance with the present invention.

Referring now to FIGS. 8-10, sideframe 14 is shown in detail as a stand alone structure. Again, sideframe 14, as well as sideframe 12 and bolster 16 are typically cast steel unitary devices, with internal ribs and supports to allow the strength necessary for the structural components of a railway freight car truck 10 while providing a generally lower weight structure. Sideframe 14 is seen to include vertical columns 44 that are longitudinally spaced and form sideframe opening 18 there between. Sideframe column vertical face 46 is also adapted to receive a sideframe column wear plate 19, which is typically affixed by bolts. Sideframe 14 is also seen to comprise a lower support section 42, which has various raised structures adapted to position spring group 36 thereupon.

Sideframe 14 is also seen to have laterally spaced pedestal jaws 24 which are the further most lateral extent of sideframe 14. Each pedestal jaw 24 forms a pedestal jaw opening, which is comprised of a roof section 28, an outer wall 26, and inner wall 29. Pedestal jaw opening is adapted to receive a bearing adapter therein.

Figure 11:
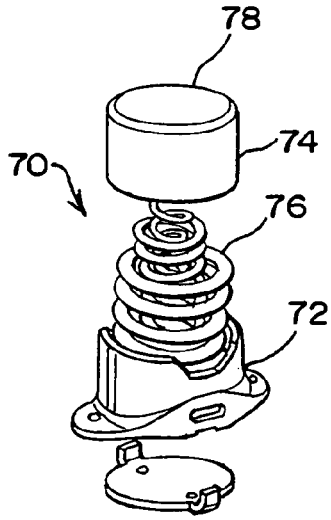
FIG. 11 is an exploded view of a first embodiment of a side bearing in accordance with the present invention.
Figure 12:
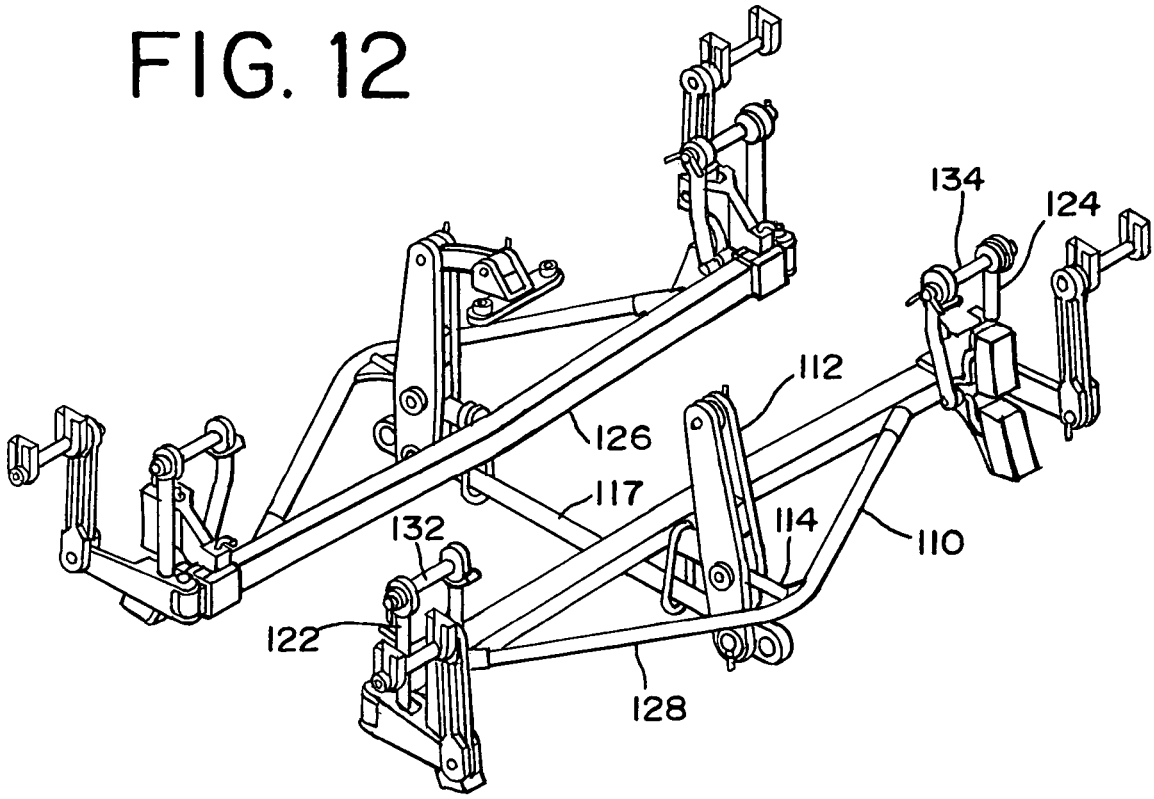
FIG. 12 is a perspective view of a first embodiment of a brake beam assembly showing two main section groups in accordance with the present invention.
Figure 13:
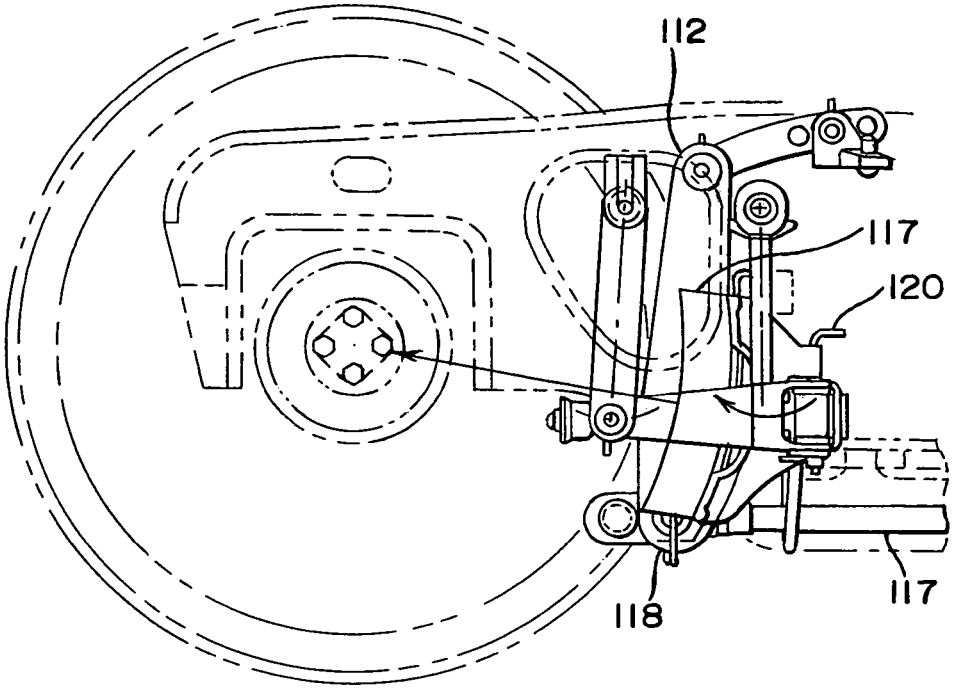
FIG. 13 is a partial view of the first embodiment of a brake beam assembly mounted in a railway car truck.

Referring now to FIG. 11, side bearing is generally shown at 70. Side bearing 70 is seen to comprise a base section 72, which is typically unitary steel or iron structure, having outer walls forming a generally circular inner opening. Coil spring 76, which can include one or more inner springs, is fitted within the opening in side bearing base 72. Side bearing cap 74 is a unitary steel or iron structure adapted to receive various side bearing coil springs 76 there within. In some embodiments, side bearing springs 76 are a combination of coil springs and solid elastomer springs. As described previously, side bearings 70 are located on a top surface of bolster 16.

Referring now to FIGS. 12-16, the detailed views of brake beam assembly 110 are shown. Brake beam assembly 110 is seen to be comprised of elongated structural brake beam main section 126 and support section 128 which is seen to extend at acute angles from each end of brake beam main section 126. Standoff 114 extends from center portion of brake beam main section 126 to the apex of the bent portion of brake beam support section 128. An operating lever 112, which is generally comprised of two spaced structural steel components, extends downwardly and is affixed to standoff 114 and to operating lever 117.

Laterally spaced hangers 122 and 124 are seen to support the ends of brake beam main section 126. Each of brake beam hangers 122 and 124 is seen to be comprised of a generally cylindrical bent steel structure, having two leg portions 142 and 144 of which leg portion 142 is generally transverse to brake beam main section 126 whereas leg portion 144 extends at an acute angle from brake beam main section 126. A joining section 146 is seen to join leg sections 142 and 144. Each of leg sections 142 and 144 is seen to end in openings adapted to receive hanger support pins 132 and 134.

Figure 14:
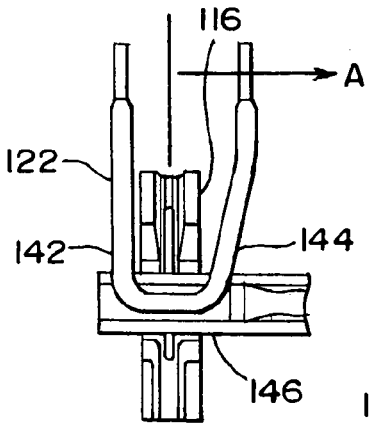
FIG. 14 is a detailed partial view of a first embodiment of a brake beam assembly in accordance with the present invention.
Figure 15:
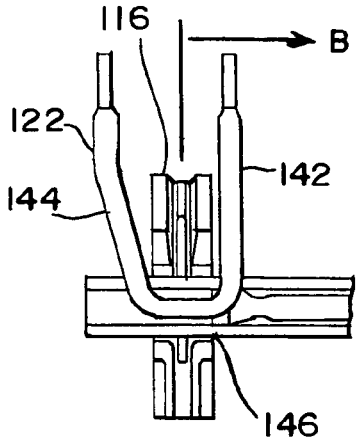
FIG. 15 is a partial detailed of a first embodiment of a hanger in a reversed position in accordance with the present invention.
Figure 16:
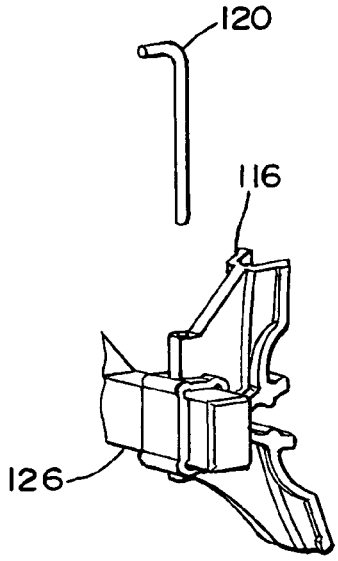
FIG. 16 is a perspective view of a brake head mounted on a main section of the brake beam assembly in accordance with the first embodiment of the present invention.

Brake head 116 is seen to be a fabricated or cast steel device adapted to receive a brake shoe 117. Brake head 116 is adapted to be received on an end portion of brake beam main section 126. Brake head 116 has an opening as does brake beam main section 126 to receive brake pin retainer 120. As can be seen from FIGS. 14 and 15, brake hanger 122 can be reversed. In FIG. 14, the lateral space between a center line of brake head 116 is seen to be a distance A. Upon the reversing of brake hanger 122, the lateral space between brake head 116 seem to be reduced to a distance B. The distances A and B correspond to two different rail gauges; thereby it is seen that by reversing one or both of brake hangers 122 or 124, the lateral space between brake heads 116 can be adjusted from a lateral distance A to a lateral distance B to thereby adapt the brake assembly 110 to be operative between two different rail gauges.

Referring now to FIG. 17, details of the spring group 36 and other suspension components are shown. As previously explained, spring group 36 is supported on sideframe lower support 42. In turn, spring group 36 supports an end 32 of bolster 16. Friction wear plates 19 are seen in previously described to be affixed to vertical wall surfaces of sideframe columns 44. Also shown are friction shoes 38. Friction shoes 38 and 40 are each seen to comprise two spaced sloped surfaces 43 and 45, a top intersection portion 41, and a rear or vertical face 62. Rear or vertical face 62 is designed to contact sideframe column wear plate 19 and thereby provide damping to bolster 16 while supported on spring group 36.

Figure 18:
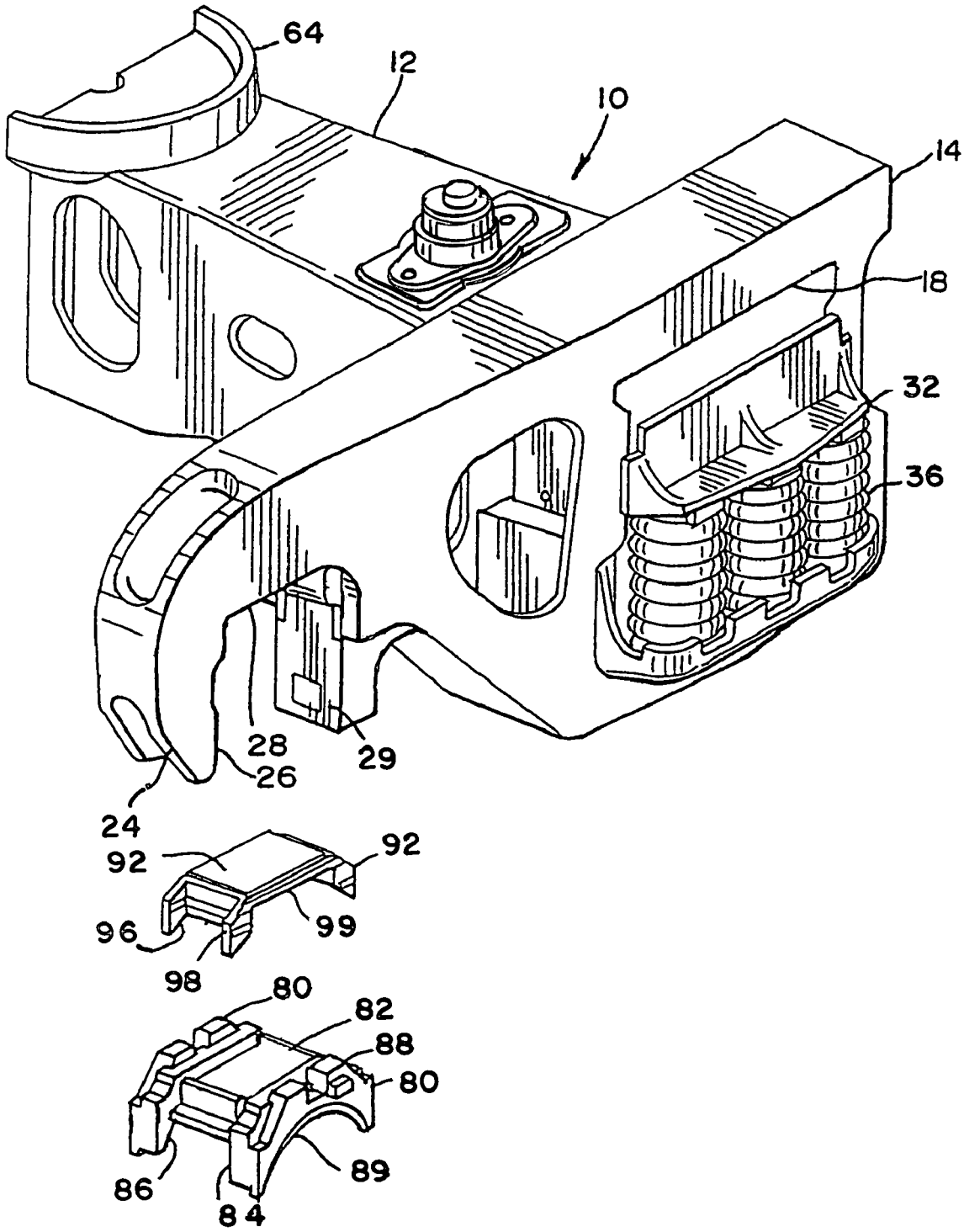
FIG. 18 is a partial perspective view of a first embodiment of a railway car truck including a bearing adapter and adapter pad in accordance with the present invention.
Figure 19:
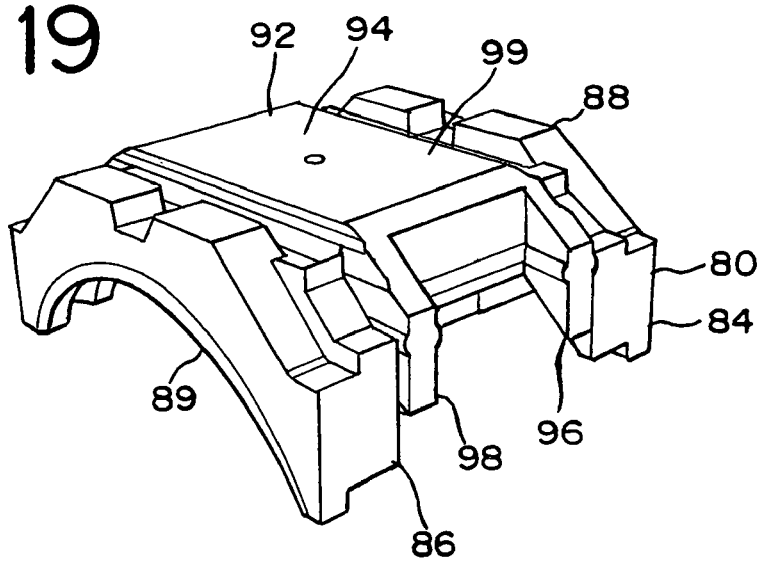
FIG. 19 is a perspective assembled view of a first embodiment of a bearing adapter and adapter pad in accordance with the present invention.

Referring now to FIGS. 18 and 19, a partial view of railway truck 10 is shown with bolster 12 having its end 32 extending into sideframe opening 18 in sideframe 14. Spring group 36 supports bolster end 32. The lateral end of bolster 14 forms pedestal jaw 24, which itself forms a pedestal opening. Pedestal opening is formed by an outer wall of pedestal jaw 24, roof section 28, and inner wall 29. Bearing adapter 80 is seen to be comprised of a unitary, steel or iron structure. Bearing adapter 80 is seen have a generally rectangular top section 80, depending shoulders 84 and 86 which extend downwardly there from with a space there between. Also formed in bearing adapter 80 is an arcuate opening 89 into which an end of axle 20 is fit.

Bearing adapter 80 also is seen to comprise raised edge supports 88 which extend upwardly at lateral edges of bearing adapter 80. A unitary adapter pad 92 is seen to be of a generally rectangular shape. Adapter pad 92 is seen to have an adapter pad top 94 which is a generally rectangular structure, and adapter pad depending legs 96 and 98 which are spaced laterally which fit inside depending shoulder 84 and 86 of bearing adapter 80. Accordingly, adapter pad 92 is seen to fit on top of bearing adapter 80. Adapter pad lateral edge 99 is seen to fit against raised edge support 88 of bearing adapter 80 thereby inhibiting the lateral movement of adapter 92 on top of bearing adapter 80. Adapter pad 92 again is a unitary structure usually of a selected elastomer or similar material. Adapter pad 92 assembled on bearing adapter 80 are shown in FIG. 19.

Figure 20:
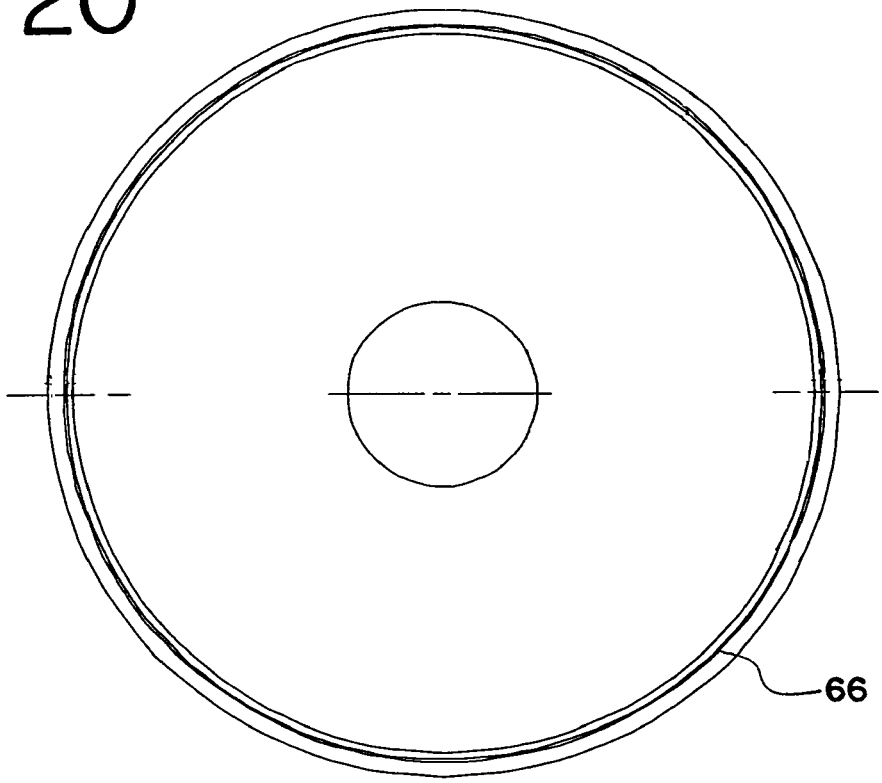
FIG. 20 is a top view of a first embodiment of a bolster center plate wear liner in accordance with the present invention.
Figure 21:
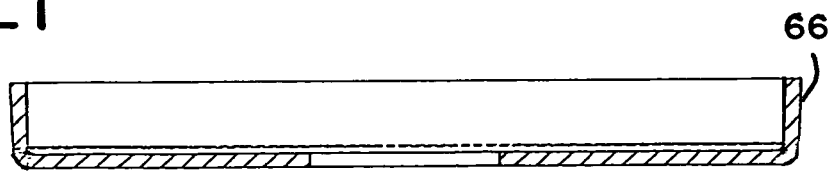
FIG. 21 is a side cross sectional view of a first embodiment of a bolster center plate wear liner in accordance with the present invention.

Referring now to FIGS. 20 and 21, bolster center plate liner is shown generally at 66. Bolster center plate liner 66 is seen to be a cylindrical or disk shaped structure which fits inside bolster center plate 64. Bolster center plate wear liner 66 is generally comprised of an austempered ductile iron structure, generally having a Brinell hardness of 340. Bolster center plate wear liner 66 assists in the capacity of railway car truck 10 being able to negotiate curves with some movement of axles 20 and 22 from a parallel position. Such turning capability of railway cat truck 10 is also greatly assisted by the structure previously described of bearing adapter 80 and adapter pad 92.

What is claimed is:

1. A railway car truck comprising two sideframes, each sideframe having a pedestal formed on longitudinally opposite ends thereof and substantially upright columns defining a sideframe opening intermediate the pedestals, a vertical surface on each column, each pedestal having a pedestal opening, a bolster transverse relative to the sideframes and having laterally opposite ends, each end extending into and supported within a sideframe opening, the bolster also including two laterally spaced side bearing pads on an upper surface of the bolster between the sideframes, a side bearing on each side bearing pad, a spring group in each sideframe opening that supports a respective end of the bolster, a friction shoe having two spaced sloped surfaces disposed between the bolster and the vertical surface of a column of a sideframe, the sloped surface of the friction shoe forcing a complementary sloped surface of the bolster, and the friction shoe having a vertical wall facing the vertical surface of a column of a sideframe, a bearing adapter and an elastomeric adapter pad received in each pedestal opening of each sideframe, two brake beam assemblies supported on the railway car truck bolster and sideframes, each brake beam assembly comprising an elongated main section having two end portions, a support section extending from the elongated main section near each end portion at an acute angle, a standoff section extending between a center portion of the elongated main section to a center portion of the support section, two brake hangers each comprised of two leg sections and a bottom section joining the leg sections, the brake hanger supported from one of the sideframes, the brake hangers supporting the elongated main section of the brake beam assembly near each end portion thereof, two brake heads each having a support section, the brake head support section being affixed to one of the end portions of the elongated main section of the brake beams, the two brake head support sections being spaced laterally apart to adapt to a first rail gauge, and wherein one or both brake hangers can be reversed such that the two brake head support sections are spaced laterally apart to adapt to a second rail gauge.

2. The railway car truck of claim 1 further comprising a brake head pin, wherein each brake head support section includes a pin opening, and each brake head support section is affixed to one of the end portions of the elongated main section of the brake beam by a brake head pin.

3. The railway car truck of claim 1 wherein each brake hanger is comprised of two leg sections, wherein each leg section includes a support opening at an end of each leg section, and wherein one of the leg sections intersects with the bottom section approximately at a right angle and the other leg section intersects with the bottom section at an acute angle, whereby, when one or both of the brake hangers are reversed in hanging from its support openings at the end of each leg section, the rail gauge between the brake head support sections is changed.

4. The railway car truck of claim 1 further comprising a load beam support extending laterally inward from a top portion of each sideframe, and a load beam extending laterally between the two sideframes, the load beam having two ends, each end affixed to one of the load beam supports on a sideframe.

5. The railway car truck of claim 1 further comprising a circular center plate on an upper surface of the bolster, the center plate located at a portion midway between the laterally opposite ends of the bolster, and a center plate liner comprised of a circular disk of austempered ductile iron having a Brinell hardness of 340.

6. A railway car truck comprising two sideframes, each sideframe having a pedestal formed on longitudinally opposite ends thereof and substantially upright columns defining a sideframe opening intermediate the pedestals, a vertical surface on each column, each pedestal having a pedestal opening, a bolster transverse relative to the sideframes and having laterally opposite ends, each end extending into and supported within a sideframe opening, the bolster also including two laterally spaced side bearing pads on an upper surface of the bolster between the sideframes, a side bearing on each side bearing pad, a spring group in each sideframe opening that supports a respective end of the bolster, a friction shoe having two spaced sloped surfaces disposed between the bolster and the vertical surface of a column of a sideframe, the sloped surface of the friction shoe facing a complementary sloped surface of the bolster, and the friction shoe having a vertical wall facing the vertical surface of a column of a sideframe, a bearing adapter and an elastomeric adapter pad received in each pedestal opening of each sideframe, two brake beam assemblies supported on the railway car truck bolster and sideframes, each brake beam assembly comprising an elongated main section having two end portions, a support section extending from the elongated main section near each end portion at an acute angle, a standoff section extending between a center portion of the elongated main section to a center portion of the support section, two brake hangers each comprised of two leg sections and a bottom section joining the leg sections, the brake hanger supported from one of the sideframes, the brake hangers supporting the elongated main section of the brake beam assembly near each end section thereof, two brake heads each having a support section, the brake head support section being affixed to one of the end portions of the elongated main section of the brake beam, the two brake head support sections being spaced laterally apart to adapt to a first rail wheel gauge, and wherein one or both brake hangers can be reversed such that the two brake head support sections are spaced laterally apart to adapt to a second rail wheel gauge, wherein each brake hanger is comprised of two leg sections, wherein each leg section includes a support opening at an end of each leg section, and wherein one of the leg sections intersects with the bottom section approximately at a right angle and the other leg section intersects with the bottom section at an acute angle, whereby when one or both of the brake hangers are reversed in hanging from its support openings at the end of each leg section, the rail wheel gauge between the brake head support section is changed.

7. The railway car truck of claim 6 further comprising a brake head pin, wherein each brake head support section includes a pin opening, and each brake head support section is affixed to one of the end portions of the elongated main sections of the brake beam by a brake head pin.

8. The railway car truck of claim 6 further comprising a load beam support extending laterally inward from a top portion of each sideframe, and a load beam extending laterally between the two sideframes, the load beam having two ends, each end affixed to one of the load beam supports on a sideframe.

9. The railway car truck of claim 6 further comprising a circular center plate on an upper surface of the bolster, the center plate located at a portion midway between the laterally opposite ends of the bolster, and a center plate liner comprised of a circular disk of austempered ductile iron having a Brinell hardness of 340.

10. A railway car truck comprising two sideframes, each sideframe having a pedestal formed on longitudinally opposite ends thereof and substantially upright columns defining a sideframe opening intermediate the pedestals, a vertical surface on each column, each pedestal having a pedestal opening, a bolster transverse relative to the sideframes and having laterally opposite ends, each end extending into and supported within a sideframe opening, the bolster also including two laterally spaced side bearing pads on an upper surface of the bolster between the sideframes, a spring group in each sideframe opening that supports a respective end of the bolster, two brake beam assemblies supported on the railway car truck bolster and sideframes, each brake beam assembly comprising an elongated main section having two end portions, a support section extending from the elongated main section near each end portion at an acute angle, a standoff section extending between a center portion of the elongated main section to a center portion of the support section, two brake hangers each comprised of two leg sections and a bottom section joining the leg sections, the brake hanger supported from one of the sideframes, the brake hangers supporting the elongated main section of the brake beam assembly near each end portion thereof, two brake heads each having a support section, the brake head support section being affixed to one of the end portions of the elongated main section of the brake beam, the two brake head support sections being spaced laterally apart to adapt to a first rail gauge, and wherein one or both brake hangers can be reversed such that the two brake head support sections are spaced laterally apart to adapt to a second rail gauge.

11. The railway car truck of claim 10 further comprising a brake head pin, wherein each brake head support section includes a pin opening, and each brake head support section is affixed to one of the end portions of the elongated main section of the brake beam by a brake head pin.

12. The railway car truck of claim 10 wherein each brake hanger is comprised of two leg sections, wherein each leg section includes a support opening at an end of each leg section, and wherein one of the leg sections intersects with the bottom section approximately at a right angle and the other leg section intersects with the bottom section at an acute angle, whereby, when one or both of the brake hangers are reversed in hanging from its support openings at the end of each leg section, the rail gauge between the brake head support section is changed.

13. The railway car truck of claim 10 further comprising a load beam support extending laterally inward from a top portion of each sideframe, and a load beam extending laterally between the two sideframes, the load beam having two ends, each end affixed to one of the load beam supports on a sideframe.

14. The railway car truck of claim 10 further comprising a circular center plate on an upper surface of the bolster, the center plate located at a portion midway between the laterally opposite ends of the bolster, and a center plate liner comprised of a circular disk of austempered ductile iron having a Brinell hardness of 340.

* * * * *